US009861138B2

(12) United States Patent
Liu

(10) Patent No.: US 9,861,138 B2
(45) **Date of Patent: *Jan. 9, 2018**

(54) ELECTRONIC CIGARETTE AND ITS SUCKING ROD

(71) Applicant: HUIZHOU KIMREE TECHNOLOGY CO., LTD., SHENZHEN BRANCH, Shenzhen, Guangdong Province (CN)

(72) Inventor: Qiuming Liu, Huizhou (CN)

(73) Assignee: HUIZHOU KIMREE TECHNOLOGY CO., LTD., SHENZHEN BRANCH, Shenzhen, Guangdong Province (CN)

( * ) Notice: Subject to any disclaimer, the term of this patent is extended or adjusted under 35 U.S.C. 154(b) by 154 days.

This patent is subject to a terminal disclaimer.

(21) Appl. No.: 14/946,738

(22) Filed: Nov. 19, 2015

(65) Prior Publication Data

US 2016/0073694 A1 Mar. 17, 2016

Related U.S. Application Data

(63) Continuation-in-part of application No. 13/813,651, filed on Jan. 31, 2013, now Pat. No. 9,254,007.

(51) Int. Cl.
*A24F 47/00* (2006.01)
*H05B 3/40* (2006.01)

(52) U.S. Cl.
CPC ..... *A24F 47/008* (2013.01); *H05B 3/40* (2013.01)

(58) Field of Classification Search
CPC ..... A24F 47/008
See application file for complete search history.

(56) References Cited

U.S. PATENT DOCUMENTS

2011/0011396 A1* 1/2011 Fang ..... A24F 47/008 128/202.21
2011/0303231 A1* 12/2011 Li ..... A24F 47/008 131/329
2012/0060853 A1* 3/2012 Robinson ..... A24F 47/008 131/191
2013/0192615 A1* 8/2013 Tucker ..... H01C 17/00 131/328
2013/0228191 A1* 9/2013 Newton ..... A61M 15/06 131/329

* cited by examiner

*Primary Examiner* — Eric Yaary
(74) *Attorney, Agent, or Firm* — Cheng-Ju Chiang

(57) ABSTRACT

An electronic cigarette sucking rod comprises a nozzle cover and a connecting module respectively inserted into opposite ends of the sucking cylinder, a conduit in the sucking cylinder, a liquid guiding component and an atomizing device between the liquid guiding component and the connecting module; the nozzle cover and the liquid guiding component respectively seal opposite ends of the liquid smoke compartment, opposite ends of the conduit are inserted into the through holes of the nozzle cover and the liquid guiding component, and a smoke passage extends through the liquid guiding component and the conduit. The liquid guiding component comprises a liquid separation seat and a liquid reservoir; the liquid separation seat comprises a seat body and a vent pipe; the vent pipe has its one end engaged with the conduit, and another end sleeved with the liquid reservoir and lead to the atomizing device; the liquid separation seat defines a liquid guiding hole.

19 Claims, 11 Drawing Sheets

A-A

ELECTRONIC CIGARETTE AND ITS SUCKING ROD

CROSS-REFERENCE TO RELATED APPLICATIONS

This application is a continuation-in-part of U.S. application Ser. No. 13/813,651, having a filing date of Jan. 31, 2013, now pending, which is incorporated by reference in its entirety and which is a national phase of PCT Application No. PCT/CN2012/076493, filed Jun. 5, 2012, both of which are incorporated herein by reference in their entirety.

TECHNICAL FIELD

This invention relates to a field of electronic cigarettes, and particularly to an electronic cigarette which is ultra-long and transparent.

DESCRIPTION OF BACKGROUND

A current electronic cigarette sucking rod comprises: an opaque sucking cylinder, a liquid smoke compartment disposed in the sucking cylinder and integrated with the sucking cylinder, an inhaling passage, an atomizing device disposed in the sucking cylinder and having a heating wire and an atomizing cup, an elongated tubular liquid conduit for guiding the liquid smoke to flow into the atomizing device, a nozzle cover disposed at an end of the sucking cylinder, and an inhaling passage for transmitting the liquid smoke in the atomizing cup to an exterior of the sucking cylinder via the nozzle cover. One end of the liquid conduit is inserted into the liquid smoke compartment, another end of the liquid conduit is inserted into the atomizing device, and the liquid smoke is guided to the atomizing device through the liquid conduit. The heating wire is welded to the positive electrode and the negative electrode respectively by riveting technology of bonding wire or copper tube.

Existing electronic cigarettes have the following shortcomings: since the liquid conduit is inserted into the liquid smoke compartment, it is complex and inconvenient to be installed, and easy to lead to leakage, and the fluid amount is also not easy to control. Secondly, the heating wire is welded or riveted to the conductive wire in advance before it is welded to the copper electrodes of the atomizer, the process is more complicated, and the installation is not easy. The inhaling passage is disposed at a side of the liquid smoke compartment and vents at the side, this would adversely affect the liquid reserving volume of the liquid smoke compartment in a predetermined volume, and decrease the liquid reserving volume of the liquid smoke compartment. The liquid smoke compartment and the inhaling passage and the sucking cylinder are integrally formed, thus the length of the electronic cigarette sucking rod is fixed. Additionally, the existing atomizing cup is constructed by several components, which is not convenient to install the heating wire. The sucking cylinder is opaque, and the liquid smoke volume in the liquid smoke compartment cannot be observed, it would cause empty to burn of the heating wire and generate odor gas after the liquid smoke has run out.

SUMMARY

An object of the present invention is to provide an electronic cigarette sucking rod, it is convenient to be installed, and has good drainage and leakproof effect, and can simplify the fabrication process of the electronic cigarette sucking rod, and has adjustable length and liquid reserving volume; the reserving volume of the liquid smoke can be increased in ensuring the relative volume of the electronic cigarette sucking rod.

To achieve the above object, the present invention provides an electronic cigarette sucking rod, comprising: a sucking cylinder, a conduit, a liquid smoke compartment, a liquid guiding component, an atomizing device, and a connecting module;

wherein the nozzle cover and the connecting module are respectively inserted into opposite ends of the sucking cylinder, the conduit, the liquid guiding component, the atomizing device and the liquid smoke compartment are located in the sucking cylinder; the nozzle cover defining a through hole therein and the liquid guiding component respectively seal opposite ends of the liquid smoke compartment, the conduit is located in the liquid smoke compartment, with its opposite ends being respectively inserted into the through hole of the nozzle cover and the through hole of the liquid guiding component, so that the nozzle cover, the liquid guiding component and the conduit form a smoke passage, and opposite ends of the smoke passage are respectively communicated with an exterior of the nozzle cover and the atomizing device; the atomizing device is located between the liquid guiding component and the connecting module; the liquid guiding component comprises mutually affixed liquid separation seat and liquid reservoir; the liquid separation seat comprises a seat body and a vent pipe run through a center of the seat body and extended toward opposite directions along a length direction of the seat body, and the through hole of the liquid guiding component is defined in the vent pipe; one end of the vent pipe is engaged with the conduit, and another end of the vent pipe is sleeved around by the liquid reservoir, and communicated to the atomizing device; the liquid separation seat defines at least one liquid guiding hole, and the liquid smoke in the liquid smoke compartment is infiltrated via the liquid guiding hole and absorbed and stored in the liquid reservoir to be atomized in the atomizing device.

Furthermore, wherein the liquid guiding component is cylindrical, and the seat body of the liquid separation seat comprises an annular wall which has its diameter larger than an annular wall of the vent pipe and its height smaller than the vent pipe, and the at least one liquid guiding hole is defined in the annular wall of the seat body in a direction parallel to the axis of the seat body; one end of the conduit is inserted into the vent pipe of the liquid guiding component.

Furthermore, wherein the vent pipe forms an inner edge at its inner wall, and said one end of the conduit is inserted into the vent pipe by expansion and abuts against the inner edge.

Furthermore, wherein the liquid reservoir is a cylinder, and is sleeved around an outer wall of the vent pipe and interferentially engaged with the outer wall of the vent pipe, a top surface of the liquid reservoir is affixed to the seat body, and a bottom surface of the liquid reservoir is adjoined to the atomizing device.

Furthermore, wherein the atomizing device comprises an atomizer for transferring the liquid smoke into fogged smoke and an atomizing cup for accommodating the atomizer, and the atomizer comprises a heating wire for atomizing the liquid smoke and a fiber element for absorbing the liquid smoke and supporting the heating wire, the fiber element abuts against the liquid reservoir to absorb the liquid smoke for atomization.

Furthermore, wherein the nozzle cover is step-shaped cylinder, and comprises an enlarged collar with a bigger outer diameter and an inner cylinder axially extending from the enlarged collar and having a smaller outer diameter, and the through hole of the nozzle cover is axially extended through the inner cylinder and the enlarged collar; the inner cylinder is sleeved to an outer wall of an end of the conduit in order to fix the conduit; the enlarged collar is engaged in an extremity end of the sucking cylinder by expansion and seals an end of the liquid smoke compartment.

Furthermore, wherein the conduit is communicated with the through hole of the nozzle cover via a positioning sleeve, the positioning sleeve is fixed in the sucking cylinder and adjoined to the nozzle cover, the positioning sleeve defines a positioning sleeve inhaling hole where the conduit is inserted and the nozzle cover is communicated and an injecting hole for injecting the liquid smoke into the liquid smoke compartment, correspondingly the nozzle cover forms an inserting post for being inserted into the injecting hole to seal the liquid smoke compartment.

Furthermore, wherein the connecting module comprises a first electrode member having its one end inserted into the sucking cylinder to fix the atomizing device into the sucking cylinder, a second electrode member and an insulating ring located between the first electrode member and the second electrode member; the second electrode member is fastened in the first electrode member via the insulating ring.

Furthermore, wherein the first electrode member comprises a first end and a second end, the first end is provide with outer threads to threadly engaged with the power rod, the second end defines a receiving chamber therein for accommodating and fixing the atomizing device, the second end is inserted and firmly fixed into the sucking cylinder, and a flange is configured between the first end and the second end to seal the sucking cylinder.

Furthermore, wherein the heating wire has its one end tightly clamped between an outer wall of the atomizing cup and an inner wall of the first electrode member to conduit the first electrode, and its another end tightly clamped between an inner wall of the insulating ring and an outer wall of the electrode member to conduct the second electrode; the atomizing cup is adjoined to the liquid reservoir, the atomizing cup is fixed into the first electrode member;

Furthermore, wherein the atomizing cup is a cylindrical cup integrally formed by a die, and comprises a positioning seat for positioning the fiber element, a heat dissipating hole for ventilation and heat dissipation, and a pair of perforation holes for insertion of opposite ends of the heating wire.

Furthermore, wherein the sucking cylinder is further sleeved with a decorative sleeve for decoration or pasting a trademark.

Furthermore, wherein the sucking cylinder 1 is a wholly transparent shell or at least partially transparent.

Furthermore, wherein the liquid reservoir is made of high temperature resistant cotton, fiberglass cotton or thick cotton cloth, capable of absorbing water and reserving water like a sponge.

The present invention further provides an electronic cigarette adopting the above described electronic cigarette sucking rod, the electronic cigarette further comprises a power rod connected with the electronic cigarette sucking rod, wherein the power rod is connected with the connecting module disposed on the sucking cylinder.

The electronic cigarette sucking cylinder is provided therein with a liquid guiding component comprising a liquid separation seat and a liquid reservoir, so that the liquid smoke is infiltrated from the liquid guiding hole of the liquid separation seat into the atomizing cup via the liquid reservoir for atomization. It is not only conveniently installed, but also has good drainage and leakproof effect.

Secondly, the opposite ends of the heating wire are respectively firmly clamped to the positive electrode and the negative electrode directly, without welding, this simplifies the fabrication process and is convenient for installation.

And then, the atomizing cup is integrally formed, and forms a positioning seat for clamping the fiber element, to allow the fiber element and the heating wire to be easily installed, which simplifies the fabrication process of the electronic cigarette sucking rod, and let the heating wire to be easily installed.

Furthermore, the conduit is used to replace the existing inhaling passage, the conduit is arranged in the sucking cylinder, and its one end is inserted into the nozzle cover to be communicated with exterior of the sucking cylinder, and its another end is inserted into the liquid separation seat to be communicated with the atomizing chamber, and the liquid smoke compartment is collectively constructed by the space between the liquid separation seat and the nozzle cover and the space between the inner wall of the sucking cylinder and the outer wall of the conduit, this can increase the liquid reserving amount of the liquid smoke compartment in the casing of a predetermined volume of the electronic cigarette sucking rod.

Additionally, the conduit and the sucking cylinder are formed by cutting a tube; this structure makes the length and the liquid reserving amount of the electronic cigarette sucking rod to be optionally adjustable.

Moreover, the sucking cylinder is made of transparent material, for facilitating to observe the amount of the internal liquid smoke, and prevent an empty burning of the heating wire after the liquid smoke has run out.

Finally, the sucking cylinder further has a decorative sleeve at its outer wall, and is can be affixed with a trademark.

The embodiments of the present invention are further described in detail in conjunction with the accompanying drawings.

DETAILED DESCRIPTION OF THE EMBODIMENTS

Figure 1:
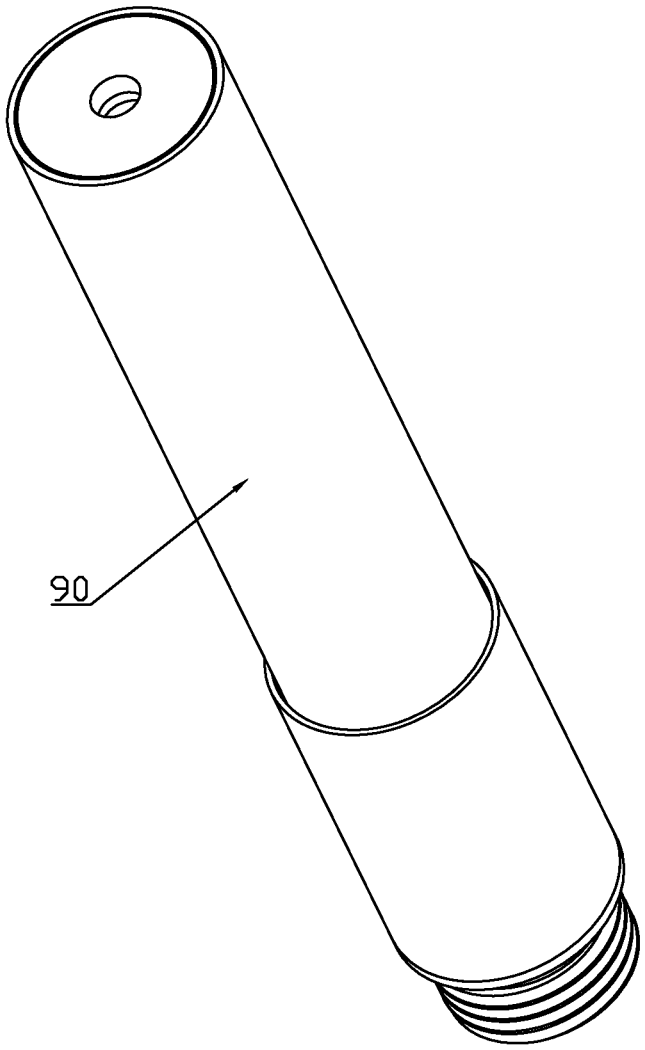
FIG. 1 is a perspective view of an electronic cigarette sucking rod in accordance with a first embodiment of the present invention.
Figure 2:
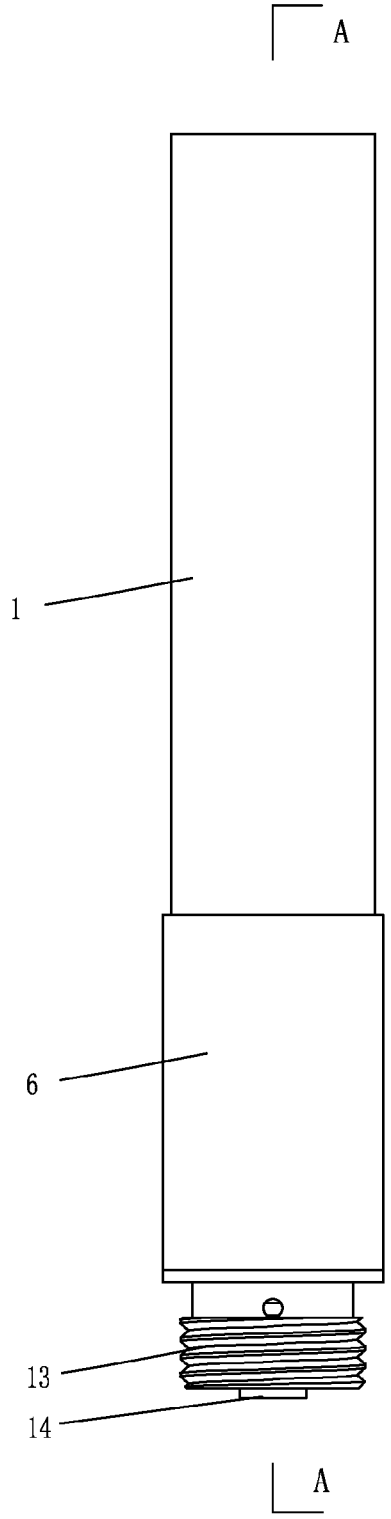
FIG. 2 is a front view of the electronic cigarette sucking rod in accordance with the first embodiment of the present invention.
Figure 3:
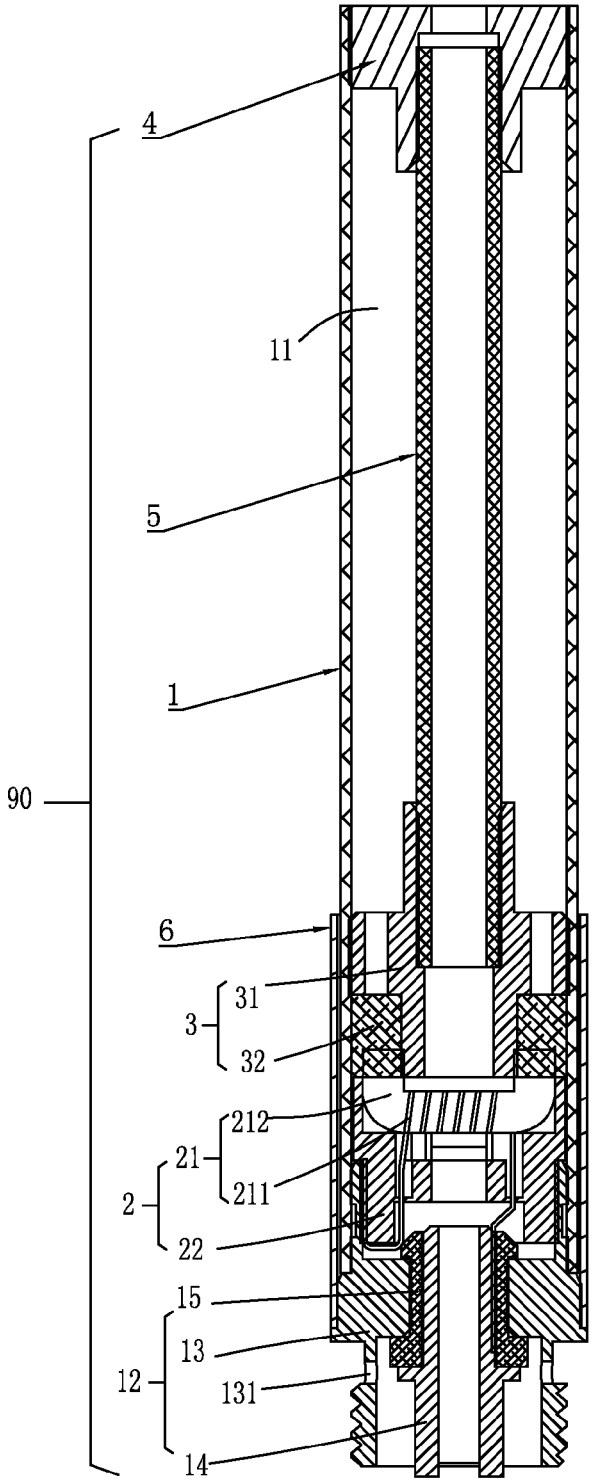
FIG. 3 is a cross-sectional view of FIG. 2, taken along A-A line.
Figure 4:
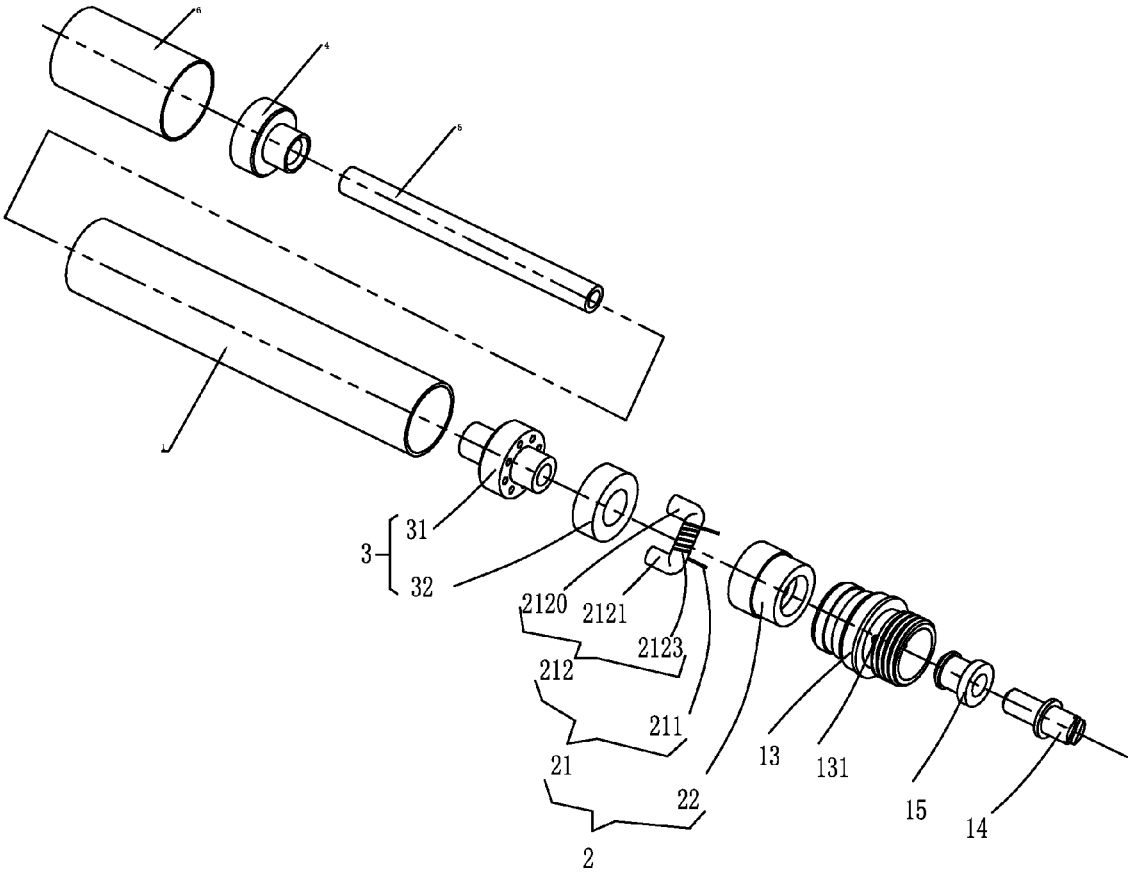
FIG. 4 is an exploded view of the electronic cigarette sucking rod in accordance with the first embodiment of the present invention.
Figure 5:
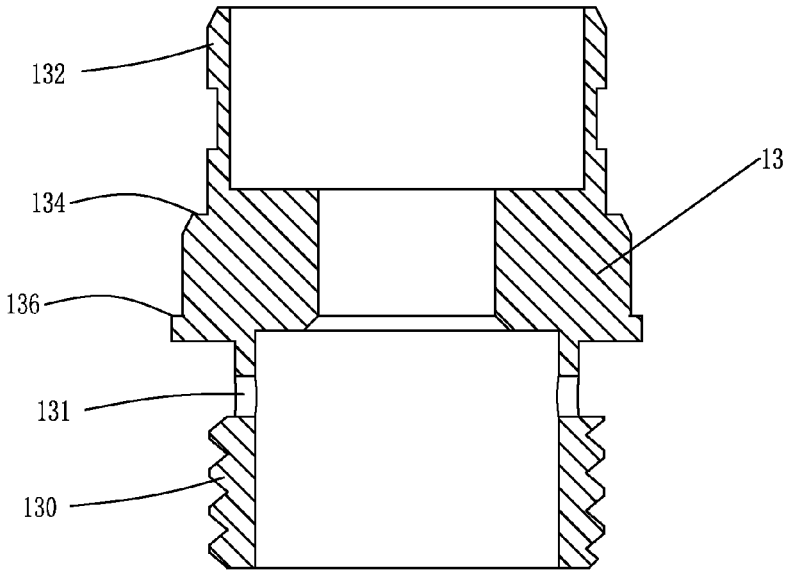
FIG. 5 is a cross-sectional view of a first electrode member of the electronic cigarette sucking rod in accordance with the embodiment of the present invention.
Figure 6:
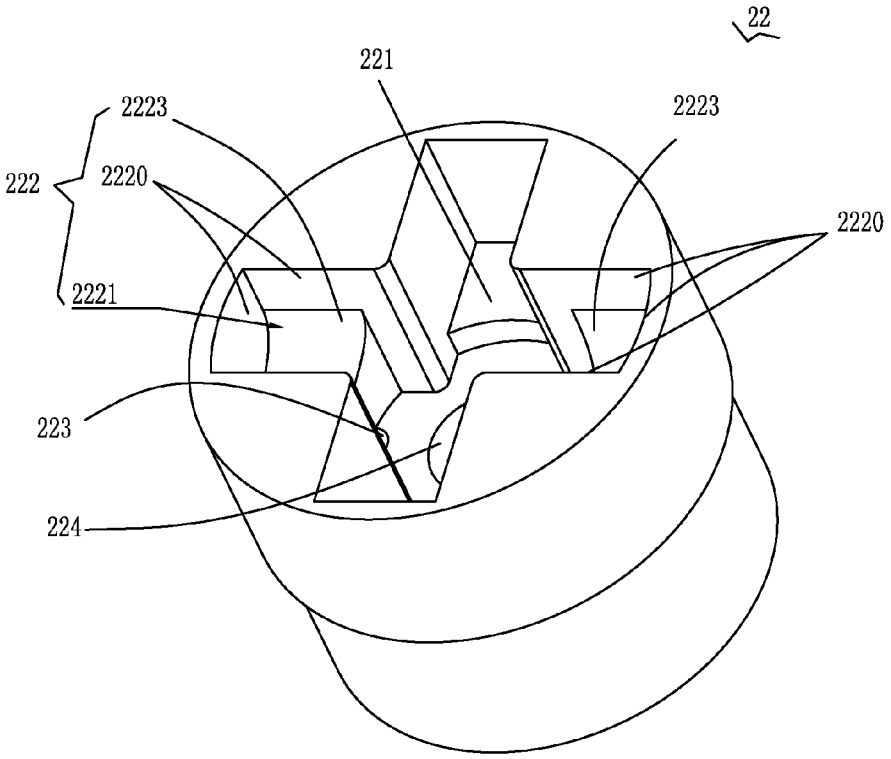
FIG. 6 is a perspective view of an atomizing cup of the electronic cigarette sucking rod in accordance with the first embodiment of the present invention.
Figure 7:
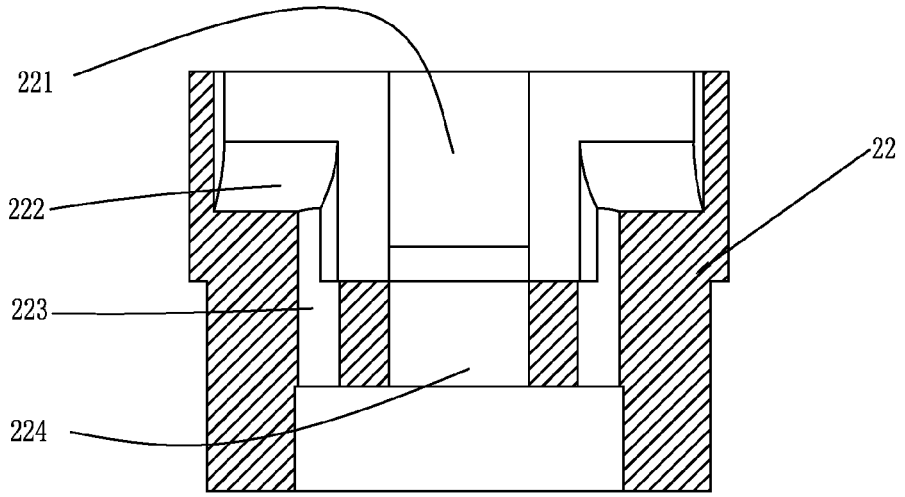
FIG. 7 is a cross-sectional view of the atomizing cup of the electronic cigarette sucking rod in accordance with the first embodiment of the present invention.
Figure 8:
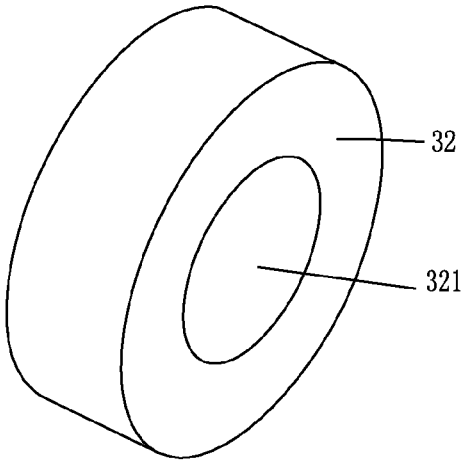
FIG. 8 is a perspective view of a reservoir of the electronic cigarette sucking rod in accordance with the first embodiment of the present invention.
Figure 9:
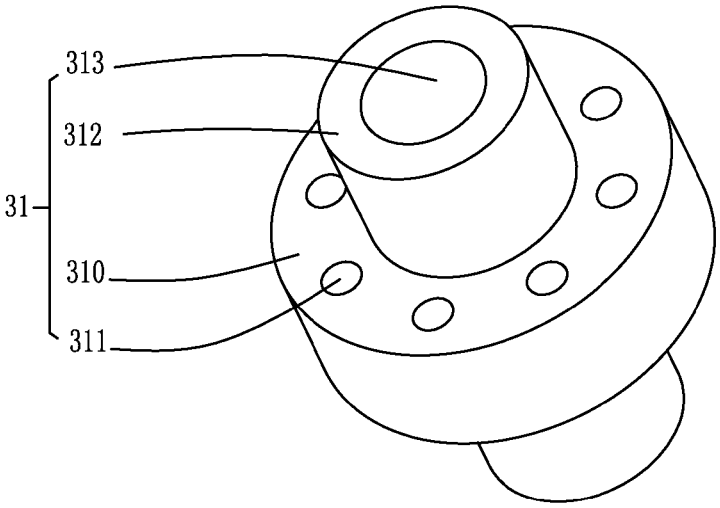
FIG. 9 is a perspective view of a liquid separation seat of the electronic cigarette sucking rod in accordance with the first embodiment of the present invention.

As shown from FIG. 1 to FIG. 13, an electronic cigarette 100 is provided according to a first embodiment of the present invention. The electronic cigarette 100 comprises an electronic cigarette sucking rod 90 and a power rod 91. The electronic cigarette sucking rod 90 and the power rod 91 are connected by fasteners, plugs, screw thread and so on, and in the embodiment by screw thread.

The electronic cigarette sucking rod 90 comprises a sucking cylinder 1, an atomizing device 2, a liquid guiding component 3 including a liquid separation seat 31 and a liquid reservoir 32, a nozzle cover 4, a conduit 5 and a decorative sleeve 6.

The sucking cylinder 1 is for installing the atomizing device 2, the liquid guiding component 3, the nozzle cover 4 and the conduit 5. The sucking cylinder 1 has a hollow tubular structure, in the embodiment, it is a cylindrical shell, and is formed by cutting a transparent or translucent elongated tube, and the length of the sucking cylinder 1 can be achieved by cutting the elongated tube according to an actual requirement. The sucking cylinder 1 comprises a terminal and a connecting end, and the nozzle cover 4 covers the terminal to facilitate the user's inhale, and the connecting end is engaged with the power rod 91.

The sucking cylinder 1 is further provided with a liquid smoke compartment 11 therein for storing the liquid smoke and a connecting module 12 for connecting with the power rod 92. The connecting module 12 comprises a first electrode member 13 served as a first electrode (the negative electrode for example) of the atomizing device 2, a second electrode member 14 disposed in the first electrode member 13 and served as a second electrode (the positive electrode for example), and an insulating ring 15. The liquid smoke compartment 11 is configured in the sucking cylinder 1, and in the embodiment the liquid smoke compartment 11 is cooperatively defined by the liquid separation seat 31, the nozzle cover 4, an inner wall of the sucking cylinder 1 and an outer wall of the conduit, and the liquid separation seat 31 and the nozzle cover 4 seal opposite ends of the liquid smoke compartment 11 to seal the liquid smoke in the liquid smoke compartment 11. The first electrode member 13 is located at the connecting end of the sucking cylinder 1. In the embodiment, the first electrode member 13 is a cylinder, and comprises a first end 130 provided with outer threads to threadly engage with the power rod 91 of the electronic cigarette, and a second end 132 inserted into the sucking cylinder 1 via the connecting end of the sucking cylinder 1 and fixedly sleeved in the sucking cylinder 1. The second end 132 defines a receiving chamber therein for accommodating and fixing the atomizing device 2. A first flange 134 is configured between the first end 130 and the second end 132 to seal the connecting end of the sucking cylinder 1, and a second flange 136 is configured around an outer wall of the first electrode member 13 for receiving the decorative sleeve 6, and the first end 130 further defines an inlet 131 for atmosphere to enter the flashlight 1. The second end 132 of the first electrode member 13 is received with the atomizing device 2, the second electrode member 14 is installed in the first end 130, and the first electrode member 13 itself is served as the negative electrode of the atomizing device 2 to electrically connect with the negative electrode inside of the power rod 91. The second electrode member 14 has its shape fitted with the first end of the first electrode member 13, and is fixed and insulated by the insulating ring 15 which is clamped between the first electrode member 13 and the second electrode member 14. The electrode member 14 uses its end side to abut against the corresponding electrode of the power rod 91 to be conducted. The sucking cylinder 1 is a wholly transparent shell or at least partially transparent, or at least a portion thereof where the liquid smoke compartment 11 is configured is transparent, to facilitate to observe the amount of the liquid smoke in the liquid smoke compartment 11.

The atomizing device 2 comprises an atomizer 21 and an atomizing cup 22. The atomizer 21 comprises a heating wire 211 and a fiber element 212 for adsorbing the liquid smoke and supporting the heating wire 211. The heating wire 211 is wound around the fiber element 412, and is fixedly accommodated within the atomizing cup 22 through the fiber element 212. The fiber element 212 is for absorbing the liquid smoke and infiltrating the liquid smoke to a place nearby the heating wire 211 to transfer the liquid smoke into fogged smoke, and is made of rope-shaped or column-shaped fiberglass. In the embodiment, the fiber element 212 is U-shaped, and its opposite ends 2120, 2121 abut against the liquid guiding component 3 to facilitate the liquid smoke to infiltrate from the liquid guiding component 3 thereto. The opposite ends 2120, 2121 of the fiber element 212 is configured as two upper parts of the U-shape and a lower part 2123 of the U-shaped fiber element 212 is connected between both upper parts 2120, 2121. Opposite ends 2120, 2121 of the fiber element 212 extend approximately along a length of the electronic cigarette upwards to the liquid guiding component 3.

The atomizing cup 22 (see FIG. 6 and FIG. 7) is integral and inseparable, is a cup integrally formed by a die, and comprises a bottom wall and an annular sidewall (not labeled) and encloses an atomizing chamber 221 therein, a positioning seat 222 defining a locking slot 2221 with a side supporting wall 2220 and a bottom supporting wall 2223, perforation holes 223, a heat dissipating hole 224 located at and passing through a central portion of the atomizing cup 22. The support wall 2220, 2223 supports the fiber element 212 in the locking slot 2221 of the positioning seat 222. The side wall 2220 of the positioning seat 222 tightly fits both upper parts 2120, 2121 of the fiber element 212 for tightly supporting the fiber element in the slot 2221. The lower part 2123 of the fiber element 212 is supported on the bottom wall 2223 of the positioning seat 222. The atomizing chamber is a rectangular slot, and is crosswise to the locking slot 2221 of the positioning seat 222, in order to ventilation. The positioning seat 222 with the locking slot 2221 is inwardly dented in a certain depth from a top surface of the atomizing cup 22 to define a dent, for positioning the atomizer 21, and the fiber element 212 is locked and positioned in the locking slot 2221 of the positioning seat 222, for easy installation. The atomizing chamber 221 is deeper than the locking slot 2221 from the top surface of the atomizing cup 22, therefore, the positioning seat 222 substantially forms a step in atomizing chamber 221. The perforation holes 223 is for insertion of the heating wire 211, and the perforation holes 223 are extended through both ends of the atomizing cup 22 and is communicated with the atomizing chamber 221. In the embodiment two perforation holes 223 are provided, and the heating wire 211 is wound around the fiber element 212, and its one end passes through the corresponding perforation hole 223, and then passes by the bottom wall of the atomizing cup 22 after bent, and is electrically connected with the first electrode member 13 after bent again. Said one end of the heating wire is tightly clamped between an inner wall of the first electrode member 13 and an outer wall of the atomizing cup 22 by mutual expansion of the atomizing cup 22 and the first electrode member 13 to get the electrical connection with the first electrode member 13. Another end of the heating wire 211 passes through another perforation hole 223 and is electrically connected with the electrode member 14, and is tightly clamped between an outer wall of the electrode member 14 and an inner wall of the insulating ring 15 by mutual expansion of the insulating ring 15 and the electrode member 14. The method of clamp realizes the electrical connection by simple process, and it is easy for installation without the use of welding. The heat dissipating hole 224 is for ventilation and allows the heat generated y the atomizer 21 to be transferred to the power rod 91. A lower end of the atomizing device 22 and an inner wall of the second end 132 of the first electrode member 13 are mutually engaged to tighten the heating wire 211. In the embodiment, the atomizing cup 22 adopts a material having good heat resistant, such as silicone material, to gain better heat insulation effect of the atomizing cup 22. The atomizing cup 22 of the embodiment simplifies the fabrication process of the electronic cigarette sucking rod, and also facilitates the installation of the atomizer 21. Furthermore, since the atomizing cup 22 is made of silicone material having good heat resistant, it has better heat insulation effect, thus, an outer wall of the sucking nozzle has low temperature during use, and would not scald user's hand or mouth.

Figure 10:
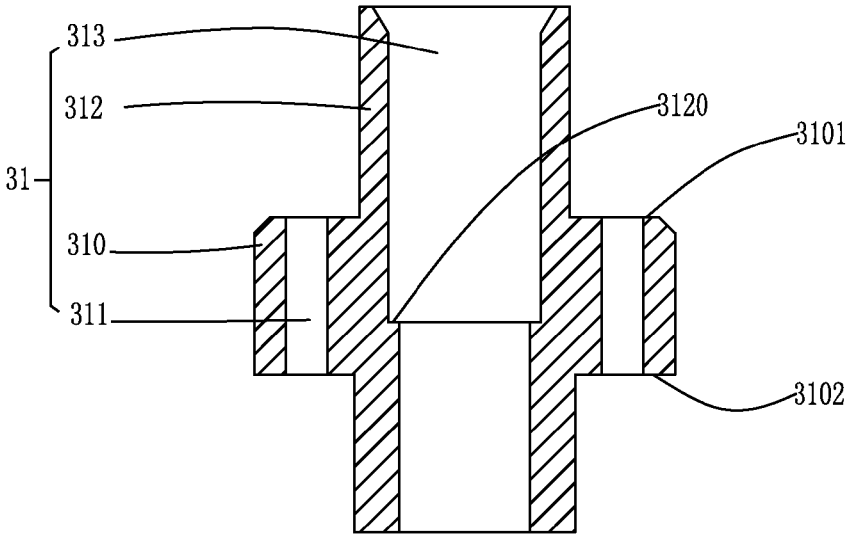
FIG. 10 is a cross-sectional view of the liquid separation seat of the electronic cigarette sucking rod in accordance with the first embodiment of the present invention.
Figure 11:
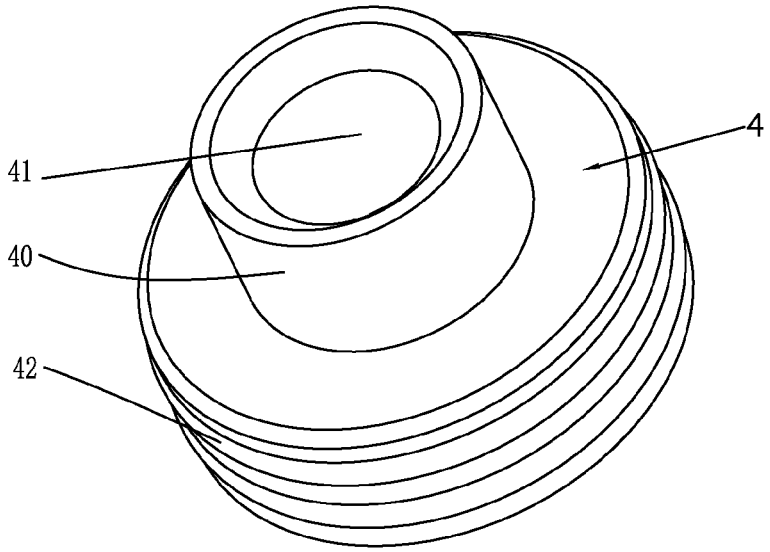
FIG. 11 is a perspective view of a nozzle cover of the electronic cigarette sucking rod in accordance with the first embodiment of the present invention.
Figure 12:
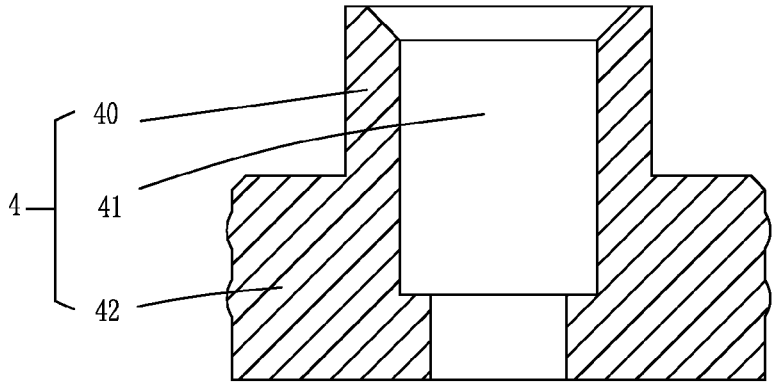
FIG. 12 is a cross-sectional view of the nozzle cover of the electronic cigarette sucking rod in accordance with the first embodiment of the present invention.
Figure 13:
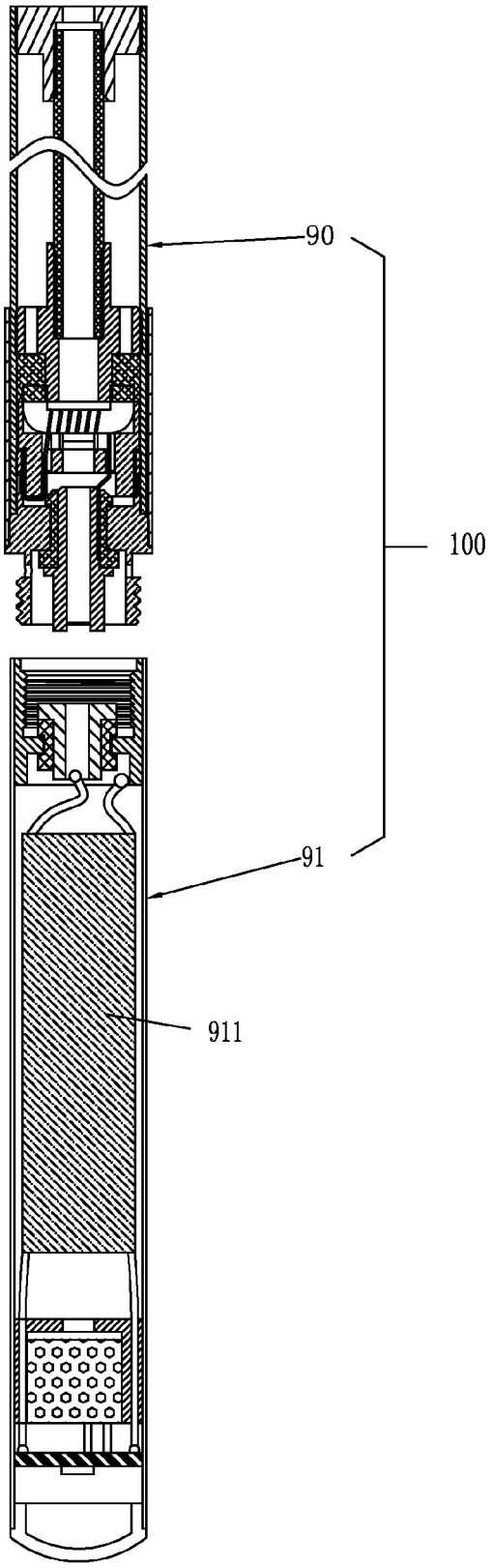
FIG. 13 is a cross-sectional view of an electronic cigarette 100 in which the electronic cigarette sucking rod in accordance with the first embodiment of the present invention is applied.

The liquid guiding component 3 is for guiding the liquid smoke in the liquid smoke compartment 11 into the atomizing cup 22 to be atomized, and comprises the liquid separation seat 31 and the liquid reservoir 32. The liquid smoke in the liquid smoke compartment 11 is infiltrated through the liquid separation seat 31 and is absorbed and stored in the liquid reservoir 32 to be atomized. The liquid separation seat 31 (see FIG. 9 and FIG. 10) comprises a vent pipe 312 and a seat body 310 sleeved around the vent pipe 312, and is made of silicone material. The vent pipe 312 defines a through hole 313 in a center thereof. The seat body 310 defines liquid guiding holes 311, and the flow volume of the liquid smoke depends on the size and amount of the liquid guiding holes 311. Referring to the directions as shown in FIG. 10, the seat body 310 comprises a top surface 3101 and a bottom surface 3102, and firmly abuts against an end of the liquid smoke compartment 11 inside the sucking cylinder 1 to seal the liquid smoke, the top surface 3101 faces the liquid smoke compartment 11. The vent pipe 312 correspondingly comprises a top end and a bottom end, and respectively communicates with the conduit 5 and the atomizing chamber 221 to allow a flow of the smoke and air. The liquid smoke is atomized by the atomizer 21 and becomes fogged smoke which passes by the vent pipe 312 from the atomizing chamber 221 to the conduit in order to be lead to an exterior of the sucking cylinder 1 or for the user to inhalation.

In one embodiment, the through hole 313 passes through the top end and the bottom end of the vent pipe 312, and forms an inner edge 3120 at its inner wall. The conduit 5 has its one end inserted into the through hole 313 by expansion, and further abutting against the inner edge 3120, in order to fix said end of the conduit 5 into the vent pipe 312.

Preferably, the vent pipe 312 and the seat body 310 both are substantially cylindrical, and coaxial with each other and have a crosswise profile. The vent pipe 312 is located at a center of the seat body 310 and its opposite ends are axially extended. The through hole 313 is an axial hole, and the liquid guiding holes 311 are extended through the annular wall of the seat body 310 in a direction parallel to the axis of seat body. Preferably, the vent pipe 312 and the seat body 310 are integrally formed. The seat body 310 of the liquid separation seat 31 comprises an annular wall in which has its diameter larger than an annular wall of the vent pipe 312 and its height smaller than the vent pipe 312.

The liquid reservoir 32 is for absorbing the liquid smoke infiltrated from the liquid separation seat 31, and is made of high temperature resistant cotton, fiberglass cotton or thick cotton cloth, capable of absorbing water and reserving water like a sponge, so that the liquid smoke can be slowly infiltrated into the atomizing cup 22. The liquid reservoir 32 and the liquid separation seat 31 are fitted with each other in shape, and the liquid reservoir 32 has its top surface affixed to the bottom surface 3102 of the liquid separation seat 310, to absorb the liquid smoke flowing out of the liquid guiding hole 311. The liquid reservoir 32 has its bottom surface affixed to the end of the atomizing cup 22 where the atomizer is disposed, and opposite ends of the fiber element 212 abut against the bottom surface of the liquid reservoir 32 in order to adsorb the liquid smoke in the liquid reservoir 32 for facilitating the heating wire 211 to atomize the liquid smoke. In related embodiments, the liquid reservoir 32 is a cylinder with its outer diameter as same as that of the liquid separation seat 31, and defines a sleeve hole 321 at its centre, and the liquid reservoir 32 is sleeved around an outer wall of the bottom end of the vent pipe 312 via the sleeve hole 321. The liquid reservoir 32 can be interferentially engaged with the outer wall of the vent pipe 312. The liquid guiding component 3 makes the electronic cigarette sucking rod 90 to be assembled conveniently, and have good drainage effect, and can prevent a leakage of the liquid smoke from the liquid smoke compartment 11.

The nozzle cover 4 is sleeved at an extremity end of the sucking cylinder 1, and is made of silicone material, for sealing the liquid smoke and fixing the conduit 5 and for ventilation. Its central portion defines a through hole 41 (see FIG. 11 and FIG. 12) where the conduit 5 is inserted, the through hole 41 is a straight holes or a stepped hole extended through the top and bottom ends of the nozzle cover 4. In the embodiment, the nozzle cover 4 is a stepped cylinder, and comprises an enlarged collar 42 with a bigger outer diameter and an inner cylinder 40 axially extending from the enlarged collar 42 and having a smaller outer diameter, and the through hole 41 is axially extended through the inner cylinder 40 and the enlarged collar 42. The inner cylinder is sleeved to an end of the conduit 5 opposing to the liquid guiding component 3 in order to fix the conduit 5; the enlarged collar 42 is engaged with the extremity end of the sucking cylinder 1 by expansion and seals an end of the liquid smoke compartment 11. The through hole 41 is communicated with the conduit 5, to form a smoke passage.

The conduit 5 is a passage to lead the fogged smoke generated by atomization of the liquid smoke through the atomizing device 2 to the exterior of the sucking cylinder 1. In the embodiment, the conduit 5 is formed by cutting a cylindrical metallic or plastic tube, and the length of the conduit 5 can be achieve by cutting the tube according to an actual requirement. The conduit 5 is disposed within the sucking cylinder 1, and its one end is inserted into the nozzle cover 4 and communicated with the exterior of the sucking cylinder 1, and its another end is inserted into the liquid separation seat 31 and communicated with the atomizing chamber 221. A joint of the conduit 5 and the nozzle cover 4 is peripherally sealed, and a joint of the conduit 5 and the liquid separation seat 31 is peripherally sealed. The conduit 5 is disposed within the sucking cylinder 1, and preferably at the centerline, this structure can achieve a smaller volume of the electronic cigarette sucking rod 90 in the case of ensuring a predetermined reserving amount of liquid smoke.

Since the length of the conduit and the sucking cylinder 1 can be achieved by cutting corresponding tubes according to an actual requirement, the length of the sucking rod 90 and the reserving volume of the liquid smoke can be adjusted according to the lengths of the sucking cylinder 1 and the conduit 5.

The decorative sleeve 6 has a cylindrical structure, and is sleeved around an end of the outer wall of the sucking cylinder 1 opposing to the nozzle cover 4, for decorative function or pasting a trademark to the electronic cigarette sucking lever 90.

For the electronic cigarette sucking rod 90 of the first embodiment, the liquid smoke is injected into the liquid smoke compartment 11 in advance, and when the nozzle cover 4 is sleeved and irremovably fixed in the sucking cylinder 1, the liquid smoke cannot be added into the liquid smoke compartment 11 again after the liquid smoke therein ran out. The electronic cigarette sucking rod 90 is disposable.

The power rod 91 comprises a battery 911 and corresponding electrodes. Before the electronic cigarette works, a little of liquid smoke is infiltrated from the liquid smoke compartment 11 through the liquid guiding component 3 and stored in the fiber element 212. During working, pressing the key (not shown) of the electronic cigarette 100 to conduct it, the heating wire 211 of the atomizing device 2 is conducted and generates heat, so that the liquid smoke stored in the fiber element 212 is heated and atomized into fogged smoke, the fogged smoke in the atomizing chamber 221 enters the conduit 5 through the vent pipe 312 of the liquid guiding component, and then passes by the through hole 41 of the nozzle cover 4 to be inhaled.

Figure 14:
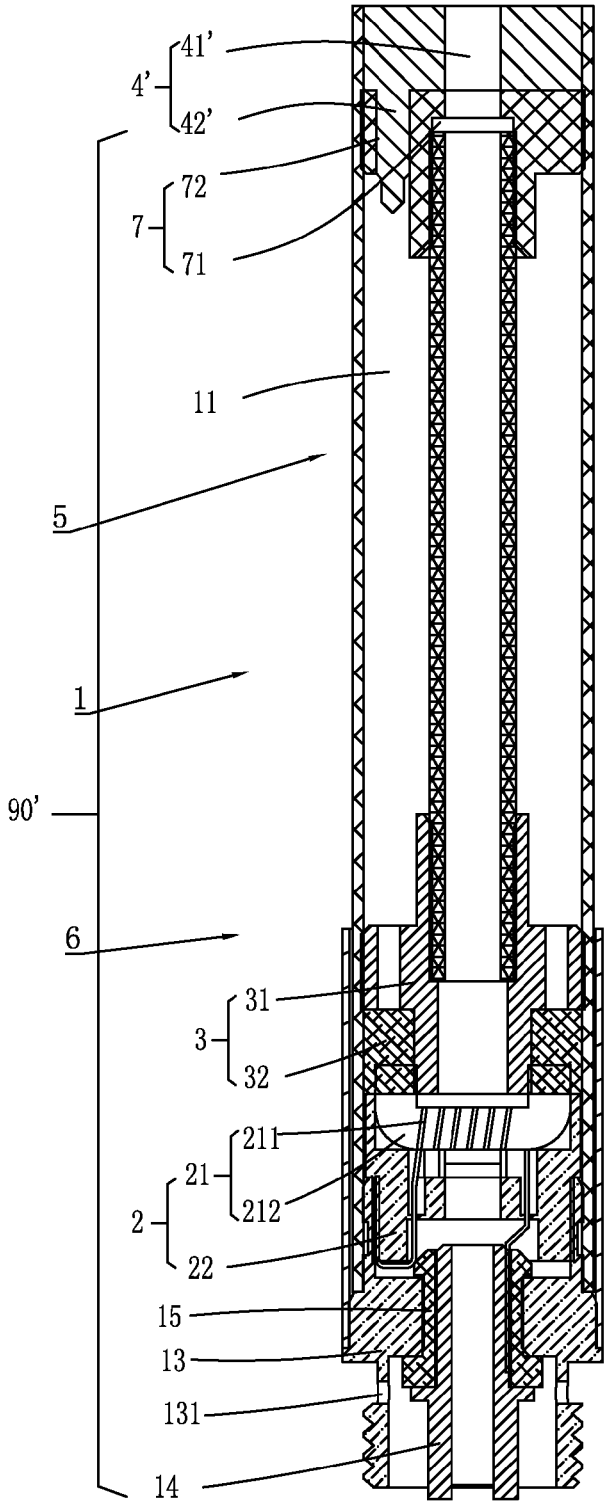
FIG. 14 is a cross-sectional view of an electronic cigarette sucking rod in accordance with a second embodiment of the present invention.

As shown in FIG. 14, another electronic cigarette sucking rod 90' is provided according to a second embodiment of the present invention, and is similar to the electronic cigarette sucking rod 90 in configuration. The difference between them is that: the nozzle cover 4' is further provided with a positioning sleeve 7 for positioning the conduit 5, the nozzle cover 4' and the positioning sleeve 7 both are made of silicone material, and the nozzle cover 4' has a substantially cylindrical shape, and the nozzle cover 4' comprises axially extended through hole 41' and inserting post 42'. The positioning sleeve 7 is substantially cylindrical, and defines a positioning hole 71 axially extended for positioning the conduit 5 and an injecting hole 72 for injecting the liquid smoke into the sucking cylinder 1. The positioning hole 71 is communicated with the through hole 41', the inserting post 42' is capable of being inserted into the injecting hole 72. The conduit 5 is inserted into the positioning hole 71 and is communicated with the through hole 41' of the nozzle cover 4' through the positioning hole 71. The positioning sleeve 7 is fixed into an end of the sucking cylinder 1 where the nozzle cover 4' is located, and a joint of the positioning sleeve and the sucking cylinder 1 is peripherally sealed. After the liquid smoke is injected into the sucking cylinder 1 via the injecting hole 72, the nozzle cover 4' is sleeved into the sucking cylinder 1 and seals the liquid smoke into the sucking cylinder 1 by its inserting post 42' inserted into the injecting hole 72. The nozzle cover 4' is movably sleeved into the sucking cylinder 1, and can be taken out of the sucking cylinder 1 after the liquid smoke ran out, and the sucking cylinder can be injected with liquid smoke again through the injecting hole 72 for further use. Therefore, the electronic cigarette sucking rod 90' is reusable.

Figure 15:
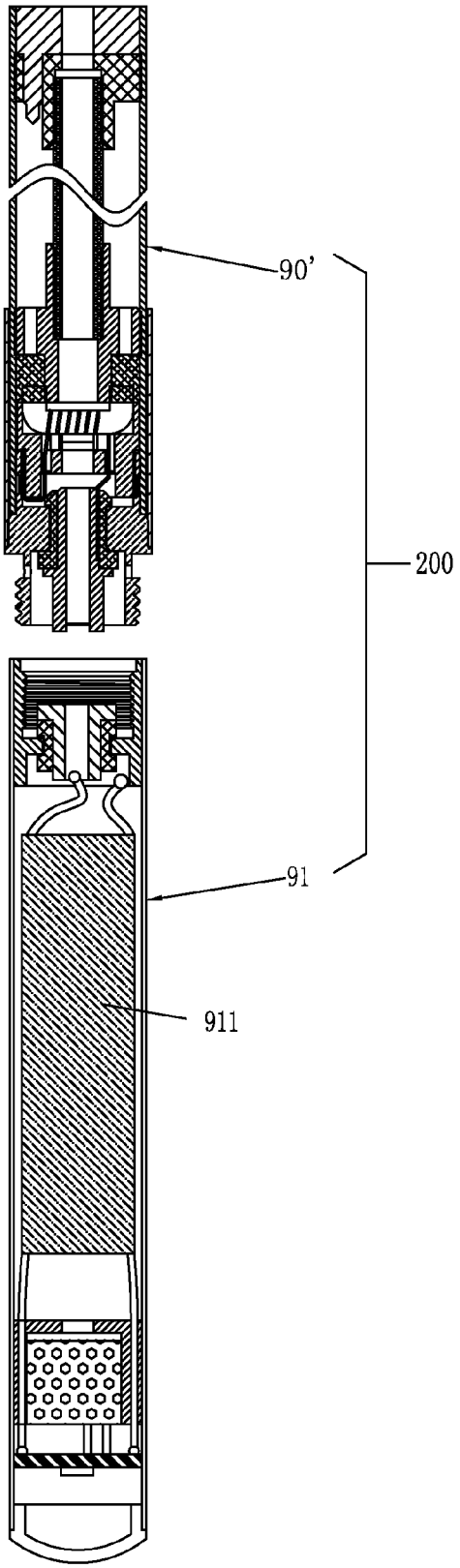
FIG. 15 is a cross-sectional view of an electronic cigarette 200 in which the electronic cigarette sucking rod in accordance with the second embodiment of the present invention is applied.

As shown in FIG. 15, an electronic cigarette 200 applying the electronic cigarette sucking rod 90' is further provided in the second embodiment of the present invention, and is powered by the power rod 91. The power rod 91 is connected with the electronic cigarette sucking rod 90'. Since the electronic cigarette sucking rod 90' is reusable, therefore the electronic cigarette 200 is also reusable.

The above-mentioned is only the embodiments of the present invention. It should be noted, for the persons of ordinary skill in this field, improvements and modifications within the spirit of the present invention can be made, and the improvements and modifications should be seemed to be included in the claimed scope of this invention.

What is claimed is:

1. An electronic cigarette sucking rod, comprising:

a sucking cylinder;

a conduit;

a liquid smoke compartment;

liquid smoke stored in the liquid smoke compartment;

an atomizing device;

a liquid guiding component infiltrating liquid smoke from the liquid smoke compartment to the atomizing device, and defining a through hole therein;

a nozzle cover defining a through hole therein; and a connecting module;

wherein the nozzle cover and the connecting module are respectively inserted into opposite ends of the sucking cylinder; the conduit, the liquid guiding component, the atomizing device and the liquid smoke compartment are located in the sucking cylinder; the nozzle cover and the liquid guiding component respectively seal opposite ends of the liquid smoke compartment, the conduit is located in the liquid smoke compartment, with its opposite ends being respectively inserted into the through hole of the nozzle cover and the through hole of the liquid guiding component whereby the through holes and the conduit form a smoke passage, and opposite ends of the smoke passage are respectively communicated with an exterior of the nozzle cover and the atomizing device; and the atomizing device comprises an atomizer and an atomizing cup, the atomizer comprises a heating wire and a fiber element for adsorbing the liquid smoke and supporting the heating wire; the heating wire is wound around the fiber element; said atomizer is accommodated within the atomizing cup through the fiber element; the fiber element is capable of absorbing the liquid smoke and infiltrating the liquid smoke for the heating wire to vaporizing the liquid smoke into fogged smoke; opposite ends of the fiber element abut against the liquid guiding component to absorb the liquid smoke from the liquid guiding component thereto;

wherein the liquid guiding component further comprises a liquid separation seat, the liquid separation seat mutually affixed to a liquid reservoir of the liquid guiding component; the liquid separation seat comprises a seat body and a vent pipe run through a center of the seat body and extended toward opposite directions along a length direction of the seat body, and the through hole of the liquid guiding component is defined in the vent pipe; one end of the vent pipe is engaged with the conduit, and another end of the vent pipe is sleeved around by the liquid reservoir, and communicated to the atomizing device; the liquid separation seat defines at least one liquid guiding hole, and the liquid smoke in the liquid smoke compartment is infiltrated via the at least one liquid guiding hole and absorbed and stored in the liquid reservoir to be atomized in the atomizing device.

2. The electronic cigarette sucking rod as described in claim 1, wherein the atomizing device is located between the liquid guiding component and the connecting module; the liquid smoke in the liquid smoke compartment is infiltrated to, absorbed and stored in the liquid reservoir to be atomized; both opposite ends of the fiber element abut against the liquid reservoir to absorb the liquid smoke for atomization; and the liquid reservoir is a cylinder.

3. The electronic cigarette sucking rod as described in claim 2, wherein the liquid guiding component is cylindrical, and the seat body of the liquid separation seat comprises an annular wall which has its diameter larger than the vent pipe and its height smaller than the vent pipe, and the at least one liquid guiding hole is defined in the annular wall of the seat body in a direction parallel to the axis of the seat body; one end of the conduit is inserted into the vent pipe of the liquid guiding component; and the vent pipe forms an inner edge at its inner wall, and said one end of the conduit.

4. The electronic cigarette sucking rod as described in claim 3, wherein the liquid reservoir is sleeved around an outer wall of the vent pipe and interferentially engaged with the outer wall of the vent pipe, a top surface of the liquid reservoir is affixed to the seat body, and a bottom surface of the liquid reservoir is adjoined to the atomizing device.

5. The electronic cigarette sucking rod as described in claim 1, wherein the nozzle cover is step-shaped cylinder, and comprises an enlarged collar with a bigger outer diameter and an inner cylinder axially extending from the enlarged collar and having a smaller outer diameter, and the through hole of the nozzle cover is axially extended through the inner cylinder and the enlarged collar; the inner cylinder is sleeved to an outer wall of an end of the conduit to fix the conduit; the enlarged collar is engaged in an extremity end of the sucking cylinder by expansion and seals an end of the liquid smoke compartment.

6. The electronic cigarette sucking rod as described in claim 1, wherein the conduit is communicated with the through hole of the nozzle cover via a positioning sleeve, the positioning sleeve is fixed in the sucking cylinder and adjoined to the nozzle cover, the positioning sleeve defines a positioning sleeve hole where the conduit is inserted and the nozzle cover is communicated and an injecting hole for injecting the liquid smoke into the liquid smoke compartment, correspondingly the nozzle cover forms an inserting post for being inserted into the injecting hole to seal the liquid smoke compartment.

7. The electronic cigarette sucking rod as described in claim 1, wherein the connecting module comprises a first electrode member having its one end inserted into the sucking cylinder to fix the atomizing device into the sucking cylinder, a second electrode member and an insulating ring located between the first electrode member and the second electrode member; the second electrode member is fastened in the first electrode member via the insulating ring.

8. The electronic cigarette sucking rod as described in claim 7, wherein the first electrode member comprises a first end and a second end, the first end is provide with outer threads to threadly engaged with the power rod, the second end defines a receiving chamber therein for accommodating and fixing the atomizing device, the second end is inserted and firmly fixed into the sucking cylinder, and a first flange is configured between the first end and the second end to seal the sucking cylinder.

9. The electronic cigarette sucking rod as described in claim 7, wherein the heating wire has its one end tightly clamped between an outer wall of the atomizing cup and an inner wall of the first electrode member to conduit the first electrode, and its another end tightly clamped between an inner wall of the insulating ring and an outer wall of the second electrode member to conduct the second electrode; the atomizing cup is adjoined to the liquid reservoir, the atomizing cup is fixed into the first electrode member.

10. The electronic cigarette sucking rod as described in claim 1, wherein the atomizing cup is integral and inseparable, and defines a heat dissipating hole for ventilation and heat dissipation, and a pair of perforation holes for insertion of opposite ends of the heating wire.

11. The electronic cigarette sucking rod as described in claim 1, wherein the sucking cylinder is further sleeved with a decorative sleeve for decoration or pasting a trademark; wherein a distal lower end of the decorative sleeve is received at a second flange formed around an outer wall of the connecting module.

12. The electronic cigarette sucking rod as described in claim 1, wherein the sucking cylinder is a wholly transparent shell or at least partially transparent.

13. The electronic cigarette sucking rod as described in claim 2, wherein the liquid reservoir is made of high temperature resistant cotton, fiberglass cotton or thick cotton cloth, capable of absorbing water and reserving water like a sponge.

14. An electronic cigarette adopting the electronic cigarette sucking rod as described in claim 1, the electronic cigarette further comprising a power rod connected with the electronic cigarette sucking rod.

15. The electronic cigarette sucking rod as described in claim 1, wherein the atomizing cup comprises a bottom wall and an annular sidewall enclosing an atomizing chamber therein; a positioning seat is provided at a top surface of the atomizing cup for positioning the atomizer in the atomizing chamber; the fiber element is positioned in the positioning seat for easy installation.

16. The electronic cigarette sucking rod as described in claim 15, wherein the positioning seat defines a locking slot is inwardly dented in a certain depth from the top surface of the atomizing cup to define a dent for positioning the atomizer; the locking slot has a supporting wall along the fiber element; and the supporting wall reliably and firmly supports the fiber element in the locking slot.

17. The electronic cigarette sucking rod as described in claim 16, the fiber element is U-shaped; two opposite ends of the fiber element are configured as two upper parts of a U-shape, and a lower part of the U-shape is connected between both opposite ends of the fiber element; the opposite ends of the fiber element extend approximately along a length of the electronic cigarette upwards to abut against the liquid guiding component to absorb the liquid smoke from the liquid smoke compartment through the liquid guiding component; the supporting wall comprises a side wall; the side wall tightly fits both upper parts of the fiber element to support the fiber element in the locking slot.

18. The electronic cigarette sucking rod as described in claim 16, wherein the atomizing chamber is crosswise to the locking slot of the positioning seat in order to ventilation.

19. The electronic cigarette sucking rod as described in claim 1, wherein the atomizing cup is made of silicone material.

* * * * *